US005099927A

United States Patent [19]

Gibson et al.

[11] Patent Number: 5,099,927

[45] Date of Patent: Mar. 31, 1992

[54] APPARATUS FOR GUIDING AND STEERING EARTH BORING CASING

[75] Inventors: Paul N. Gibson, Saluda, S.C.; Leo J. Barbera, St. Augustine, Fla.

[73] Assignee: Leo J. Barbera, St. Augustine, Fla.

[21] Appl. No.: 656,855

[22] Filed: Feb. 19, 1991

Related U.S. Application Data

[63] Continuation-in-part of Ser. No. 646,852, Jan. 28, 1991.

[51] Int. Cl.[5] ..... E21B 7/08; E21B 47/024

[52] U.S. Cl. ..... 175/45; 33/304; 175/61; 175/73

[58] Field of Search ..... 175/24, 22, 73, 74, 175/77, 78, 103, 94, 45, 61, 62; 299/1, 31, 58; 33/304, 313

[56] References Cited

U.S. PATENT DOCUMENTS

| | | | |
|---|---|---|---|
| 3,415,329 | 12/1968 | Marlind | 175/73 X |
| 3,939,926 | 2/1976 | Barnes et al. | 175/45 X |
| 4,013,134 | 3/1977 | Richmond et al. | 175/73 |
| 4,042,046 | 8/1977 | Capoccia | 175/73 |
| 4,293,046 | 10/1981 | Van Steenwyk | 175/45 |
| 4,438,820 | 3/1984 | Gibson | 175/45 |
| 4,977,967 | 12/1990 | Alston et al. | 175/73 X |
| 5,014,795 | 5/1991 | Gibson | 175/73 |

*Primary Examiner*—Stephen J. Novosad
*Attorney, Agent, or Firm*—Cort Flint

[57] ABSTRACT

Apparatus for guiding and steering pipe casing bored and pushed underground by an earth boring machine is disclosed which includes hinge assemblies pivotally connecting a steering head to a front casing. Each hinge assembly includes two pivots. A first pivot has a horizontal pivot axis and a second pivot has a vertical pivot axis. Preferably, the hinge assemblies are compound hinges so that the pivots are carried by a unitary hinge assembly. Actuators are provided which impart an actuation force on the steering head to rotate the steering head about the first and second pivot axes. One of the actuators is provided by slidably mounting one of the hinge assemblies so that the first and second pivot axes of that hinge assembly are compounded and moved unitarily. A second actuator is connected to the steering head to move the steering head about the first pivot axis while the hinge assembly slides to pivot the steering head about the second axis.

33 Claims, 5 Drawing Sheets

APPARATUS FOR GUIDING AND STEERING EARTH BORING CASING

This is a continuation-in-part of co-pending U.S. Pat. application Ser. No. 07/646,852, filed Jan. 28, 1991, entitled DIRECTIONAL DRILLING SYSTEM WITH ECCENTRIC MOUNTED MOTOR AND BIAXIAL SENSOR, incorporated by reference.

BACKGROUND OF THE INVENTION

The invention relates to apparatus for guiding and steering pipe casing to form a cased bore underground by boring and pushing the casings through a bore with an earth boring machine. In particular, the invention relates to a guidance and steering apparatus in which the direction of the pipe casing is controlled in both the vertical and horizontal planes during boring.

Prior earth boring machines are known which are slidably mounted and reciprocated longitudinally along a track by means of a hydraulic piston assembly. The forward end of the boring machine rotatably mounts an auger which is rotated within the interior of the pipe casings with the forward end of the auger boring a hole in the earth. The auger bores the hole and carries the dirt outwardly for ejection at the boring machine. The hydraulic pistons are forced on the boring machine to drive the pipe casings through the bore as it is formed. Successive pipe casings are attached to the string of pipe casings as the bore progresses. A steering head is typically located at the forward pipe casing and is provided with a directional control device. Typical earth boring machines are disclosed in U.S. Pat. Nos. 4,042,046, 4,013,134, and 4,438,820. U.S. Pat. No. 4,042,046 discloses an earth boring machine having a double jointed steering head so that its direction may be controlled in both the vertical and horizontal planes. However, the resulting mechanism is relatively complicated and unreliable because it involves considerably more moving parts which are at the end where the cutting occurs and considerable dynamic forces are imparted. The system does not have a reliable means for measuring the position of the cutting head in both the horizontal and vertical planes so that it may be steered accurately. U.S. Pat. Nos. 4,042,046 and 4,013,134 utilize a conventional water level to determine the grade of the casing. That type of device includes a sight tube on an indicator board at the boring pit station connected to a water line affixed to the top of the casing being bored and pushed through the ground. Any deviation in the leading edge of the casing from the desired grade either up or down provides a corresponding response to the water level in the sight tube at the boring pit. Based on the readings of the sight tube, the operator in the boring pit may pivot the steering head of the casing in the vertical plane by means of a mechanical linkage. However, the water line connected to the sight tube must be vented on both ends. If the device is used below the water table, water can enter the tube and interfere with the reading of the sight tube. The water level devices also have inherent vibration problems with necessitate that the apparatus be shut down to take a reading of the sight tube. The sight tube cannot be monitored simultaneously with the boring operation. With the vibrations, air locks are often created which interfere with the accuracy of the reading in the sight tube. The above inaccuracies can result in the final line being off grade which often requires re-boring. U.S. Pat. No. 4,438,820 proposes an improved rate sensor for eliminating the problems utilized in water level sensors. However, the problem remains that the prior art earth boring machines for cased bores do not recognize the ability to provide means for accurately measuring the position of the steering head in both the vertical and horizontal planes as opposed to being able to sense grade only. The result is that even if the grade of the cased bore is accurate, the cased bore has deviated in its horizontal position.

In addition to the limitations of the position sensors of the prior art earth boring and casing machines, have been the problem of suitable mechanical means for pivoting the steering head relative to the casings in two degrees of freedom so that large mechanical portions are not required. Prior boring machines have utilized circular pivot flanges, such as shown in U.S. Pat. No. 4,042,046, and mechanical actuation rods affixed to the steering head which are actuated by racks assemblies to pivot the steering head. Pivot connections of the type utilized heretofore in the prior art have required large mechanical portions to move the steering head which have prevented them from being precisely controlled by small incremental forces necessary for accurate steering.

Accordingly, an object of the present invention is to provide an improved guidance and steering apparatus for an earth boring machine which accurately controls the direction of a steering head and cased bore formed thereby in both the horizontal and vertical planes in a simple and reliable manner.

Another object of the present invention is to provide improved hinge assemblies for connecting the steering head to a forward casing of an earth boring machine so that the steering head may be simply and reliably rotated in two-degrees of freedom by small mechanical forces and precise control.

Another important object of the present invention is to 15 provide an improved guidance system for an earth boring machine which accurately measures the position of a pipe casing during boring operations to accurately and continuously display deviations in the vertical and horizontal directions.

Another object of the present invention is to provide an improved guidance and steering system for an earth boring machine wherein deviations from vertical and horizontal positions of a pipe casing can be determined and nullified by precisely moving the steering head in two-degrees of freedom during boring.

Another object of the invention is to provide an improved hinge assembly for pivotably connecting a steering head and forward casing of an earth boring machine which includes a low friction bearing so that the steering head may be rotated about two orthogonal axes under precise mechanical control and precise steps.

SUMMARY OF THE INVENTION

The above objectives are accomplished according to the present invention by providing an earth boring apparatus for boring and laying pipe casings to form a cased bore from a boring station pit to a destination point which includes a steering head carried by a forward pipe casing. A first hinge assembly connects the forward casing and steering head for rotation about a first axis and a second hinge assembly connects the same for rotation about a second axis orthogonal to the first axis. An actuation mechanism is connected to the steering head for imparting an actuation force to rotate the steering head through the first and second hinge assemblies about the first and second axes which steers the steering head in corresponding vertical and horizontal directions. At least one of the hinge assemblies includes a slidable hinge assembly which slides relative to the forward casing having a first pivot coinciding with the first axis, and a second pivot coinciding with the second axis so that the steering head rotates through the slidable hinge means about the first and second axes. The other hinge assembly is fixed to the forward casing and fixed to the steering head. The actuator mechanism includes a first actuator for rotating the steering head about the first axis, and a second actuator for rotating the steering head about the second axis. The slidable hinge assembly is connected to the second actuator. The first and second actuators each include an actuator rod carried by the casings which reciprocates in a linear motion, a drive motor, and transmission for imparting an actuator force to the actuation rod in response to the drive motor. The drive motor includes a rotating drive shaft, and the transmission translates the rotation of the drive shaft to linear motion for reciprocating the actuator rod. A motor control controls the drive motor to drive the drive shaft in opposite drive directions for reciprocating the actuator rod in opposite directions. Preferably, both hinge assemblies include a bearing mount carried by the steering head. An annular bearing is carried about the bearing mount constructed from a low friction material. A bearing hinge is carried by the forward casing which surrounds the bearing so that the bearing is sandwiched between the bearing mount and bearing hinge. A guidance system measures the vertical and horizontal positions of the forward pipe casing during boring. The guidance system includes a first sensor for measuring a first position angle of the casing with respect to the first axis and generating a first position angle, and a second sensor for measuring a second position angle of the casing with respect to a second axis and generating a second position angle. The first and second sensors includes a pair of angular rate sensors for measuring the angular rate of the casing about the first and second axes for generating first and second angular rate signals. An integrator integrates the first and second angular rate signals to generate the first and second position angles. A computer processes the first and second position angles and a distance signal for calculating deviations in the vertical and horizontal positions of the casing with respect to a desired bore path. A visual display may display the deviations with respect to left and right deviations and vertical deviations. The motor control may include a manual control handle for controlling the motor drive in response to the display of deviations to steer the steering head and nullify the deviations.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
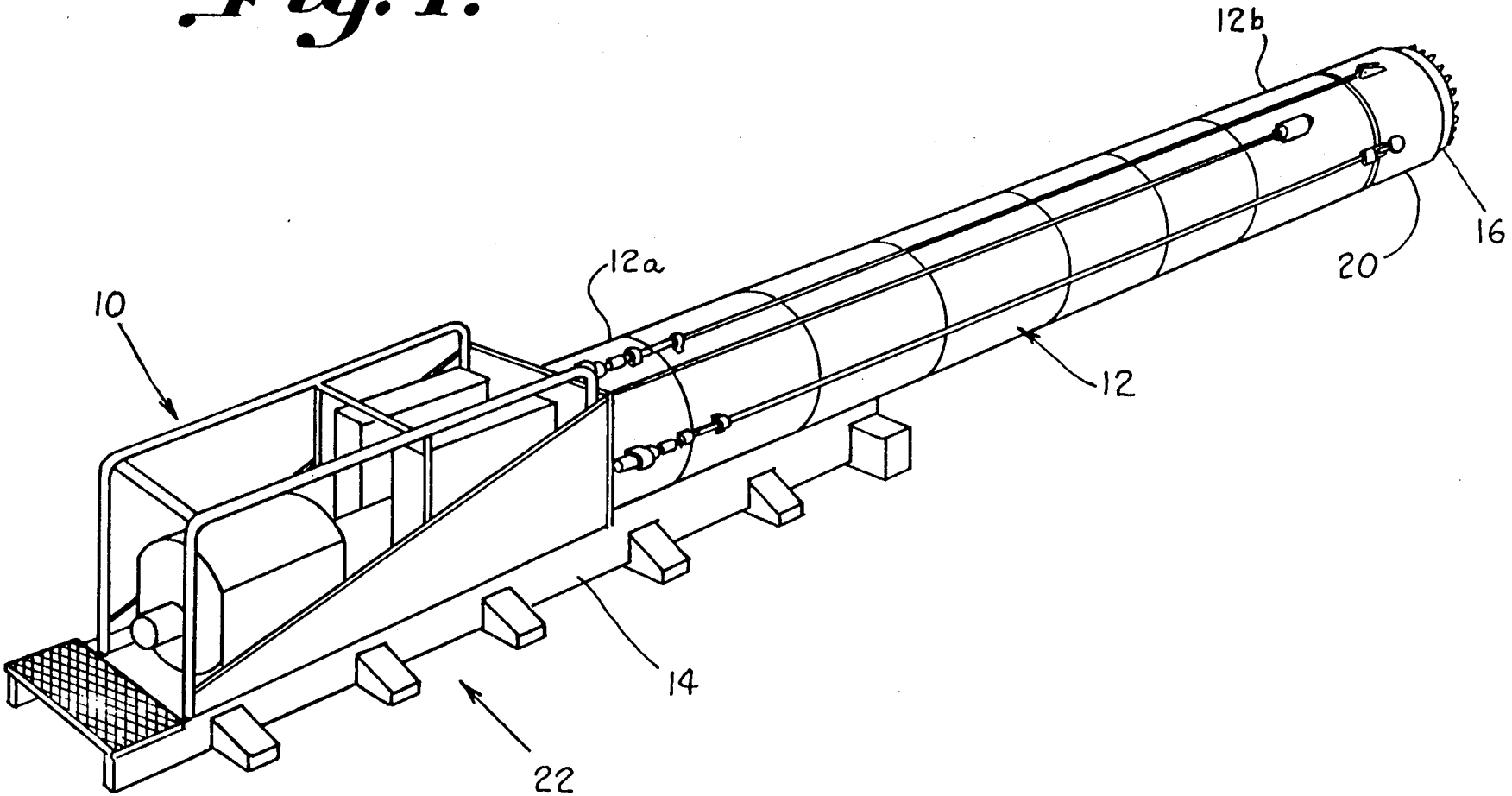
FIG. 1 is a perspective view of an earth boring machine for forming a cased bore having a guidance and steering system according to the invention.

Referring now in more detail to the drawings, an earth boring machine, designated generally as 10, is illustrated which may be any suitable machine such as a Model 36-600, horizontal earth boring machine manufactured by American Augers of Wooster, Ohio. Such earth boring machines are well known, and only those portions of a machine necessary to an understanding of the invention will be illustrated. The earth boring machine is driven by a hydraulic motor which actuates a push bar or piston (not shown) to force steel pipe casings, generally designated as 12, along a track 14 as they enter the earth and are forced through a bore which is cut up by a cutting head 16. As the cased bore is formed, the hydraulic pusher is retracted and a new casing 12 is connected to a rear casing **12*a* and then the new casing is pushed forward. This continues until the cased bore is completed. At the forward end of the string of casings, there is a forward casing 12*b* pivotally connected to a steering head, designated generally as 20. Cutting head 16 is carried by steering head 20 in a conventional manner and an auger (not shown) inside the interior of the casings 12 carries the cut materials through the casings to be injected by the boring machine 10 at the boring pit station 22**.

Figure 4:
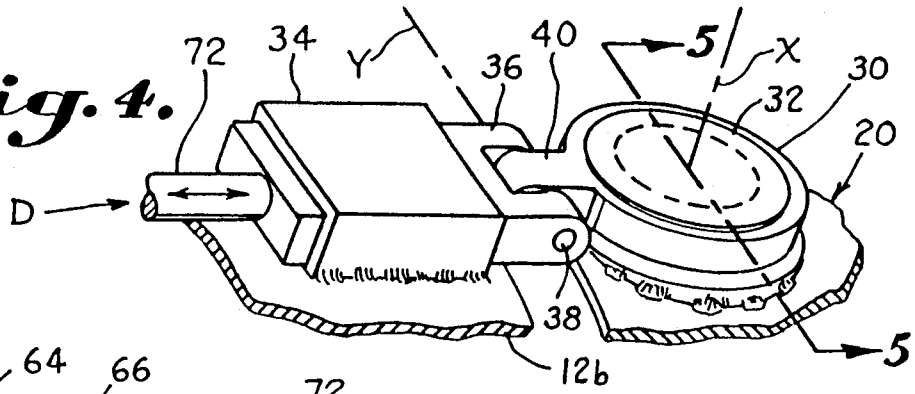
FIG. 4 is an enlarged perspective view illustrating a hinge assembly for connecting a steering head and casing which provides for rotation about two orthogonal axes in accordance with the invention.

As can best be seen in FIGS. 2–5, hinge means for connecting steering head 20 and forward casing **12*b* is illustrated for rotation of the steering head about first and second orthogonal axes X and Y. There is a first hinge means A having two-degrees of freedom about the X and Y axes and a second hinge means B having two-degrees of freedom about those axes. Preferably, each hinge means includes a hinge assembly which includes a bearing mount 24, and an annular bearing 26 which surrounds an annular hub 28 of the bearing mount. A bearing hinge 30 surrounds bearing 26. A cover plate 32 covers the bearing hinge and internally encloses bearing 26 and bearing mount 24. In the illustrated embodiment, second hinge means B includes a slidable hinge assembly (FIG. 4). There is a Teflon slide bearing 34 affixed to forward casing 12*b*. A slide member 36 is slidably received in slide bearing 34 and includes a second pivot 38** which coincides with axis Y.

Figure 2:
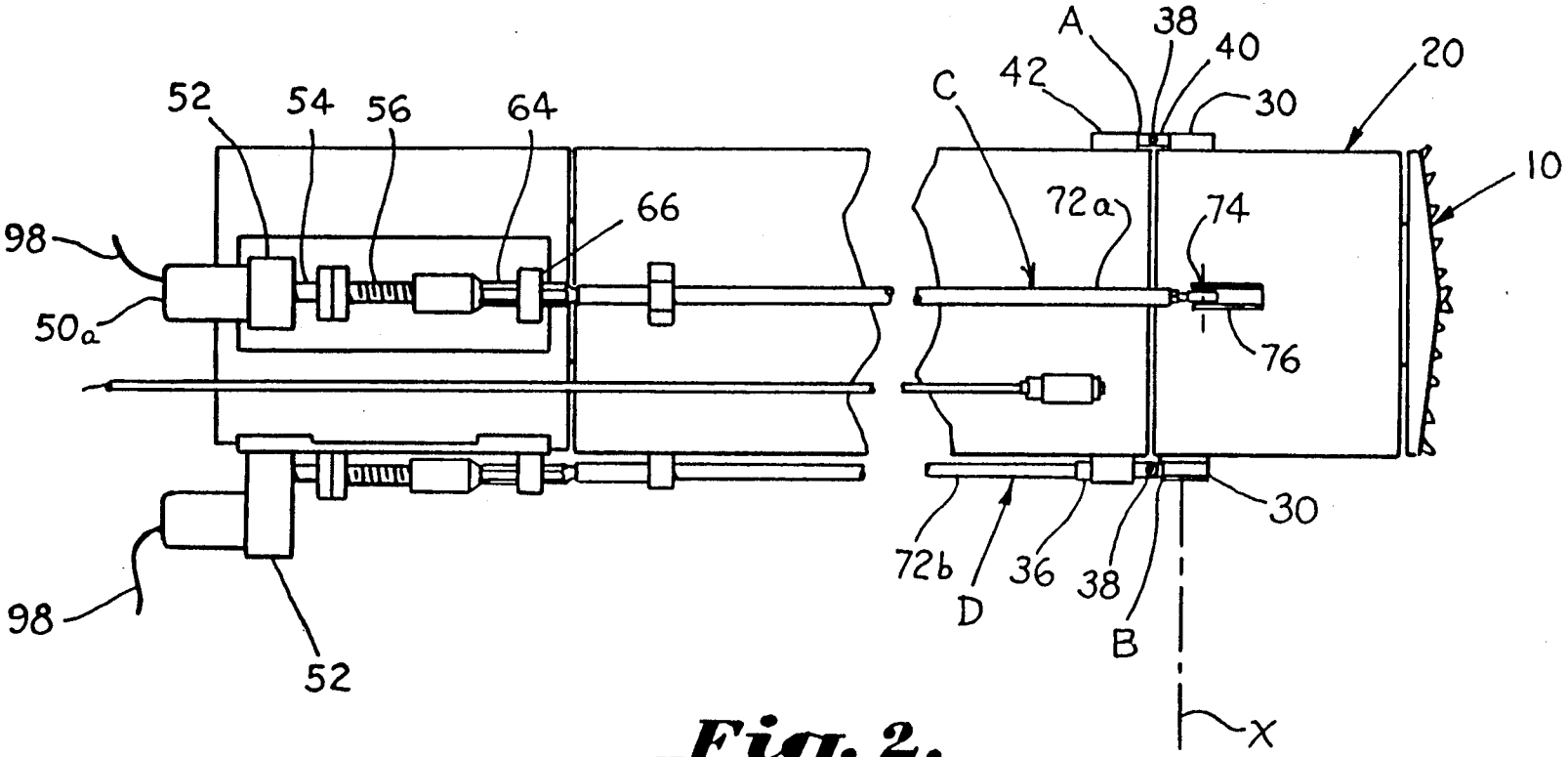
FIG. 2 is a top plan view of the earth boring machine of FIG. 1.

Pivot 38 is pivotably connected to an arm 40 which is one piece with bearing hinge 30. In this manner, a hinge assembly is provided which has two pivots. A first pivot about the X axis and a second pivot about the Y axis. The first pivot means A may be constructed essentially as second hinge means B described above. However, first hinge means A is fixed and does not slide. For this purpose, arm 40 of first hinge means A is attached to a member 42 which is affixed to the front casing 12*b* by any suitable means such as welding (FIG. 2). While it is preferred that both hinge assemblies are constructed using a bearing described above, it may be possible that one of the hinge assemblies, such as A, be constructed from a ball or swivel joint. The bearing structure described above provides a very low friction bearing for pivoting of steering head 20 in the vertical plane with small mechanical forces. In this manner, small precise movements may be imparted to steering head 20 by a control motor to steer the casing according to a desired grade (vertical) and line (horizontal). Bearing 26 may be constructed from any suitable low friction material such as a suitable graphite, Teflon, or other suitable polymeric material.

Figure 3:
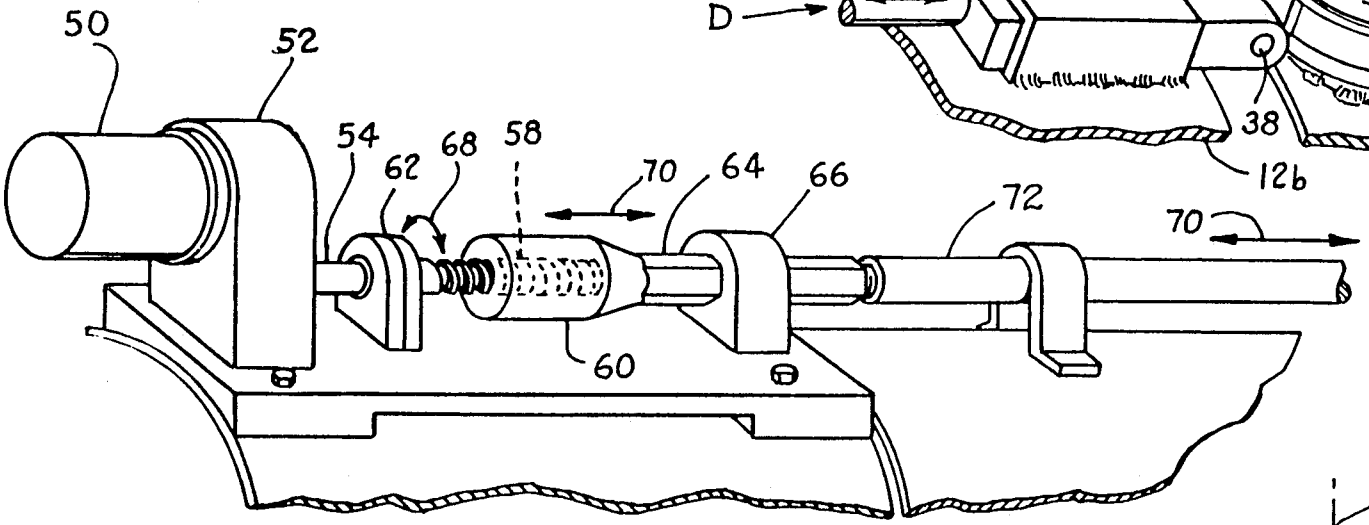
FIG. 3 is a partial perspective view of a control and actuation assembly for moving a pivotable steering head of an earth boring machine according to the invention.
Figure 5:
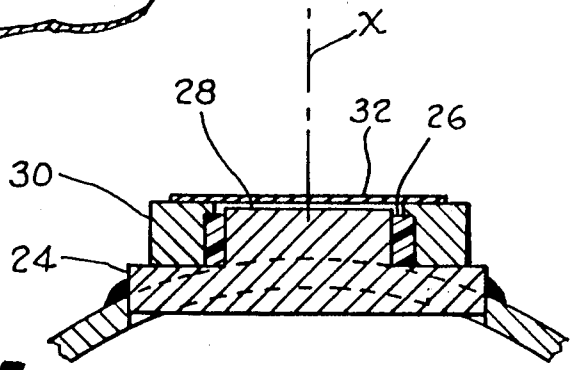
FIG. 5 is a sectional view taken along line 5—5 of FIG. 4.
Figure 7:
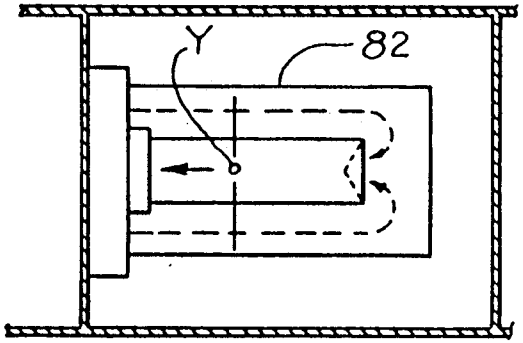
FIG. 7 is a sectional view taken along line 7—7 of FIG. 6.

As can best be seen in FIG. 3, actuation means is connected to steering head 20 for imparting an actuation force which rotates the steering head through the first and second hinge means about the first and second axes. The actuation means includes a first actuation means, designated generally as C, and a second actuation means, designated generally as D. Preferably, each actuation means includes a drive motor 50 having a drive shaft (not shown) connected to a gear or reduction box 52 which reduces the rpm of the drive shaft. Gear box 52 has an output shaft 54 with screw threads 56 formed on a free end which are received in a threaded bore 58 of a coupling member 60. A thrust bearing 62 receives the output shaft 54 of gear reduction box 52. Coupling 60 includes a coupling shaft 64 which includes a hexagonal profile that is received in a bearing box 66 to limit rotation of coupling shaft 64. In this manner, the rotational motion 68 of output shaft 54 is translated into reciprocating linear motion in the direction shown by arrow 70. Motor 50 may be any suitable control motor such as an electric or hydraulic motor driven in incremental motions to impart precise rotational control movements. Coupling shaft 64 is connected to an actuator rod. A first actuator rod 72*a* is connected to a ball or swivel joint 74 affixed to steering head 20 by means of a bracket 76. A second actuator rod 72*b* of second actuator means D is attached to slide member 36 (FIG. 2). Thus, reciprocating linear motion of first actuator rod 72*a* will cause steering head 20 to be raised or lowered about horizontal axis A in a pitch motion to change the grade. Actuation of rod 72*b* will cause steering head 20 to pivot about pivot 38 and the Y axis to steer steering head 20 left or right in a yaw motion.

Figure 6:
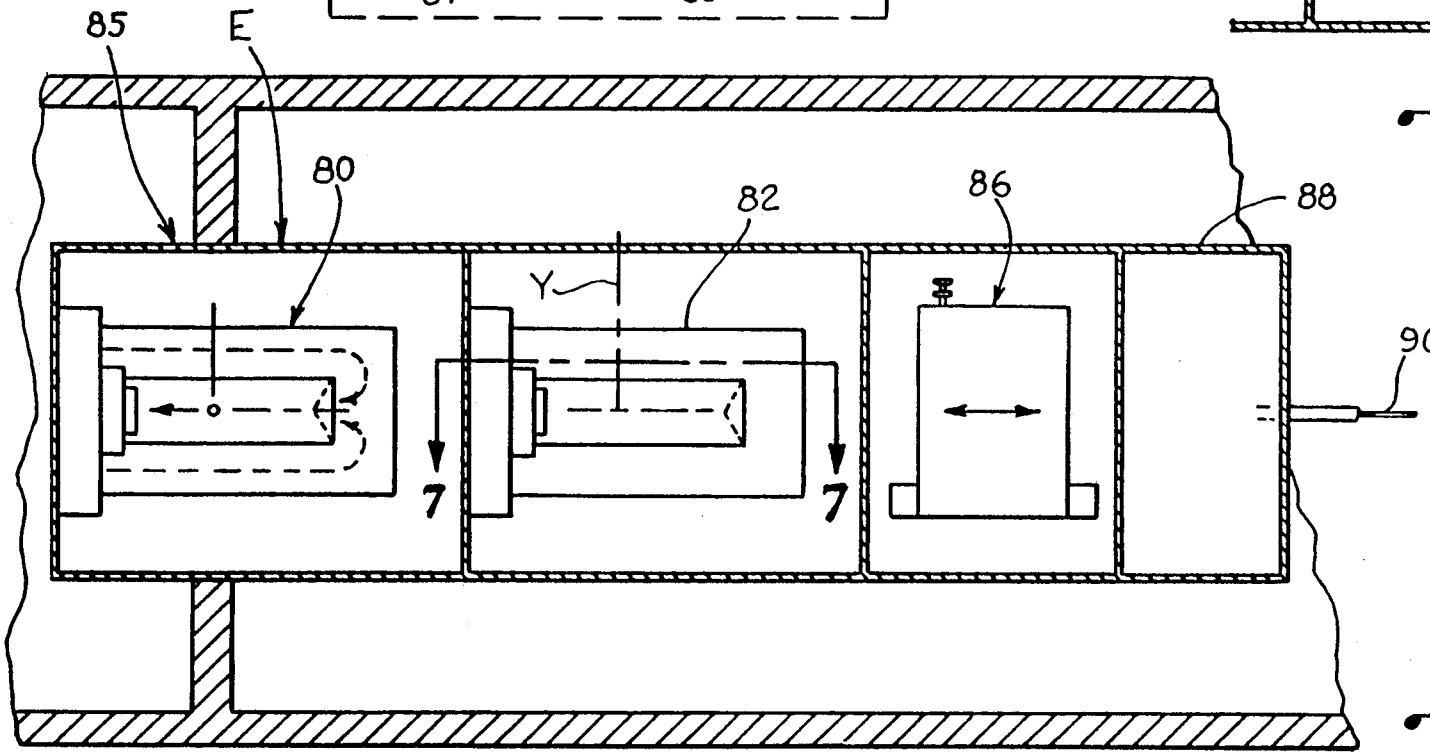
FIG. 6 is a sectional view of a steering head illustrating a guidance system for measuring the position of a steering head in a horizontal and vertical plane in accordance with the invention.
Figure 9:
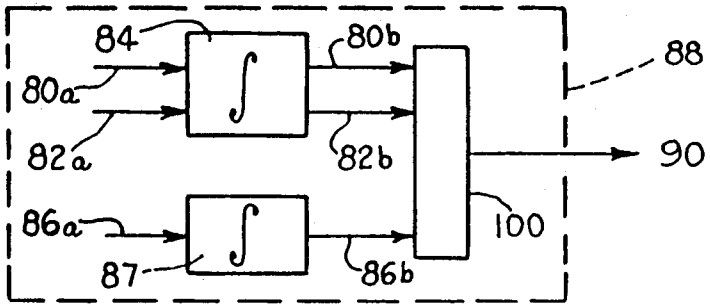
FIG. 9 is a schematic block diagram of a guidance circuit according to the invention.

Position measuring means E for measuring the position of front casing 12*b* in the vertical and horizontal directions with reference to axes X and Y is illustrated, as can best be seen in FIG. 6. Position measuring means E includes a first sensor means 80 for measuring a position angle of the front casing with reference to a first axis which coincides with axis X. There is a second sensor means 82 for measuring a position angle of the steering head with respect to a second axis which coincides with axis Y. Preferably, first and second sensor means 80, 82 each include an angular rate sensor which senses the angular rate about the X and Y axes. A suitable angular rate sensor is manufactured by Humphrey, Inc. of San Diego, Calif. A rate gyro or other suitable rate sensor may also be utilized. Angular rate signals 80*a* and 82*a* corresponding to the angular rates about the X and Y axes are output from sensors 80, 82, and delivered to an integrator 84 which integrates the angular rate signals against time to produce position angles 80*b* and 82*b* which represent the absolute position angle of the steering head with respect to the horizontal axis X and the vertical axis Y (FIG. 9). Integrator 84 may include two conventional integrator circuits for individually integrating signals 80*a* and 82*a*, such as a conventional chopper-stabilized operational amplifier circuit. Preferably, angular rate sensors 80, 82 are carried in a housing 85 affixed to forward casing 12*b*. In this manner, the exact vertical and horizontal positions of a casing may be determined and compared to the starting path of the forward casing to determine deviations in that position.

Figure 8:
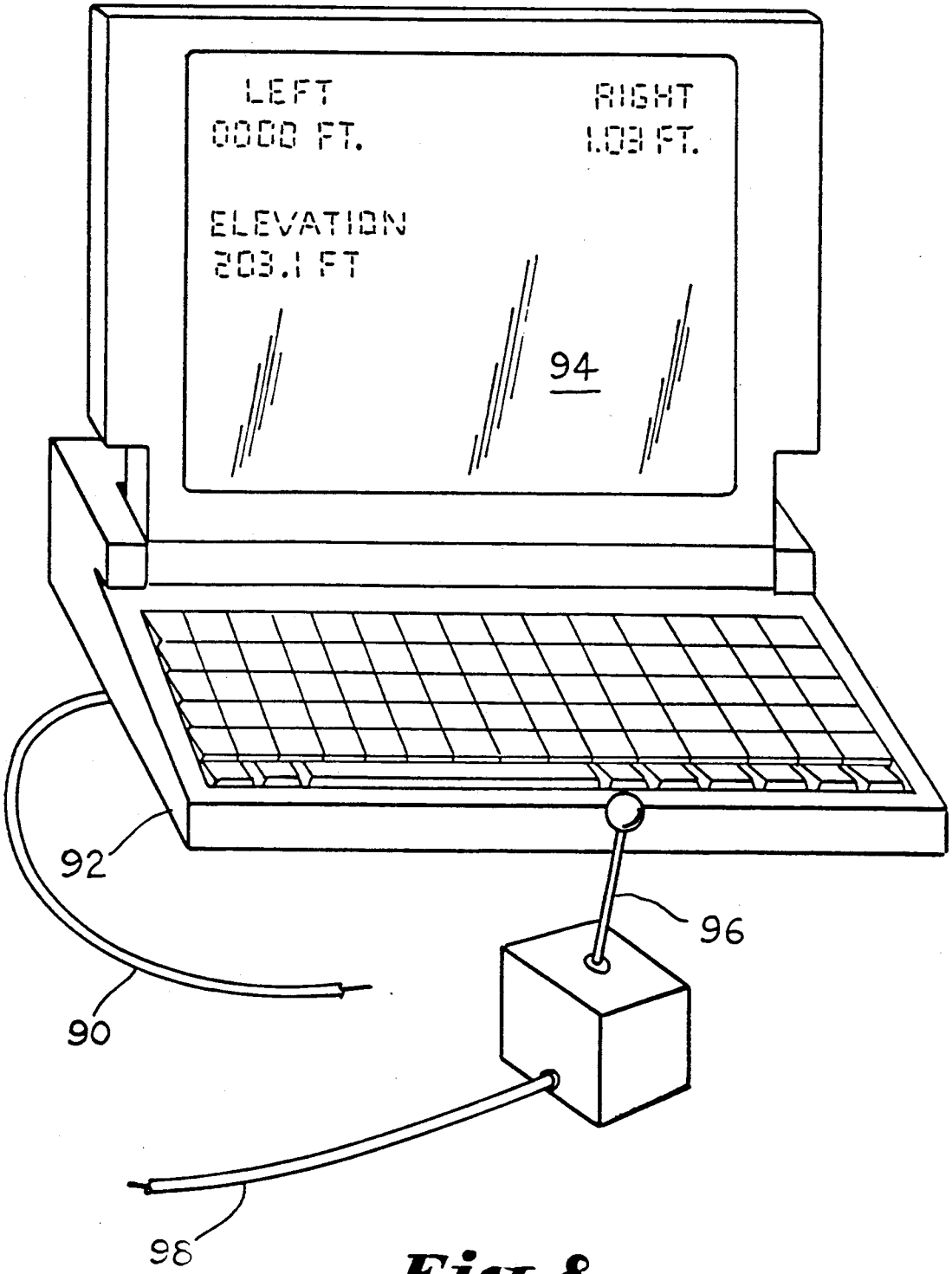
FIG. 8 is a perspective view illustrating a lap top computer and manual control for steering a steering head of an earth boring machine according to the invention in response to a visual display of deviations in the position of the steering head in the horizontal and vertical planes.

Distance measuring means 86 is provided for measuring the distance the front casing has traveled from the boring pit. Preferably, distance measuring means 86 is an accelerometer carried in housing 85 which produces a linear rate change signal 86*a* which is integrated in an integrator 87 to produce an absolute distance travel signal 86*b*. Position angle signals 80*b* and 82*b*, together with distance signal 86*b*, may be transmitted over a signal line 90 to a general computer 92 which processes the signals and calculates deviations in the travel of front casing 12*b* from the desired path. In the other illustrated embodiment, the horizontal deviations of left and right on a visual display 94 of computer 92. Changes in the vertical position are noted in terms of elevation, as can best be seen in FIG. 8. Control means may be an automated control means or may be provided by a manually operated joy stick 96. The operator at the boring pit may read the deviations on the computer display 94 and move joy stick 96 to control drive motors 50*a* and 50*b* to move actuator rods 72*a* and 72*b* accordingly to rotate steering head 20 vertically and horizontally and nullify any deviations appearing on the display.

A conventional analog to digital converter circuit may be used to convert the integrated horizontal and vertical angular rate signals, and the distance traveled signal from analog to digital signals. A conventional RS232 circuit (not shown) may be used to process the digital signals and feeds the digital signals to a microprocessor or conventional lap-top computer 92 in the form of serial data along conductor 90.

The horizontal position angle is multiplied by the distance traveled and this provides the operator with a right-left position. The vertical position angle is multiplied by the distance traveled which furnishes the operator with an up and down position or an elevation position as displayed. A prescribed path may also be established by inputting the coordinates of a reference path and comparing actual position to the reference path, rather than by computing deviations from a starting point. The guidance system is non-magnetic and is not influenced by anything but the displacement of the casing. By using a low rate accelerometer, the distance traveled deviations can be accurately measured.

To begin drilling operation, steering head 20 is oriented at a starting point in boring station pit 22 at a desired grade and line to reach a desired point. The reference entry angle (grade) of the drilling head and the drill string is input into the computer, the line is also set by a transit and referenced. The display of computer 92 displays the positions of the steering head as the pipe casing proceeds during boring operations. The instantaneous position and elevation of the casing are measured and computed in response to the horizontal and vertical position angle signals from angle sensors 80, 82 and distance traveled signals from accelerometer. Preferably, deviations in the line (horizontal position) and grade (vertical position) are measured from the starting point. The deviation of the drilling head on the display 94 along with the elevation, as can best be seen in FIG. 8.

While a preferred embodiment of the invention has been described using specific terms, such description is for illustrative purposes only, and it is to be understood that changes and variations may be made without departing from the spirit or scope of the following claims.

What is claimed is:

1. Earth boring apparatus for boring and laying pipe casings underground beginning at a boring station pit to form a cased bore which includes means for forming a bore and pushing the pipe casings through the bore as it is formed, said apparatus comprising:

a plurality of pipe casings joined together having a forward casing at a forward end of said casings;

a steering head carried by said forward casing;

a cutting head carried by said steering head for forming said bore;

first hinge means connecting said forward casing and steering head for rotation about a first axis and a second axis orthogonal to said first axis;

second hinge means connecting said forward casing and steering head for rotation about said first and second axes; and actuation means connected to said steering head for imparting an actuation force to rotate said steering head through said first and second hinge means about said first and second axes to steer said steering head in corresponding vertical and horizontal directions.

2. The apparatus of claim 1 wherein at least one of said first and second hinge means includes a slidable hinge means which slides relative to said forward casing having a first pivot coinciding with said first axis and a second pivot coinciding with said second axes so that said steering head rotates through said slidable hinge means about said first and second axes.

3. The apparatus of claim 2 wherein the other of said first and second hinge means is fixed to said forward casing and to fixed said steering head.

4. The apparatus of claim 1 wherein said actuation means includes:

a first actuator for rotating said steering head about said first axis; and a second actuator for rotating said steering head about said second axis.

5. The apparatus of claim 4 wherein at least one of said first and second hinge means includes a slidable hinge means which slides relative to said forward casing having a first pivot coinciding with said first axis and a second pivot coinciding with said second axis so that said steering head rotates through said slidable hinge means about said first and second axes, and said slidable hinge means is connected to said second actuator.

6. The apparatus of claim 4 wherein said first and second actuators each include:

an actuator rod carried by said casings which reciprocates in a linear motion;

a drive motor; and transmission means for imparting said actuator force to said actuation rod in response to said drive motor.

7. The apparatus of claim 6 wherein said drive motor includes a rotating drive shaft; and said transmission means includes means for translating the rotation of said drive shaft to linear motion for reciprocating said actuator rod.

8. The apparatus of claim 7 including a gear box for reducing the rotational rate of said drive shaft of said drive motor, and said gear box includes an output shaft having a reduced rotational rate.

9. The apparatus of claim 8 wherein said output shaft includes a threaded end, and said translating means includes a coupling having a threaded interior bore for receiving said screw threads of said output shaft, a coupling shaft carried by said coupling, and means for limiting rotation of said coupling shaft so that rotation of said output shaft causes said coupling shaft to move in said linear motion; and means for connecting said coupling shaft to said actuator rod.

10. The apparatus of claim 9 including a thrust bearing in which said output shaft of said gear box is received.

11. The apparatus of claim 6 including control means for controlling said drive motor to drive said drive shaft in opposite drive directions for reciprocating said actuator rod in opposite directions.

12. The apparatus of claim 1 wherein at least one of said first and second hinge means includes:

a bearing mount carried by said steering head;

bearing means carried about said bearing mount constructed from a low friction material; and a bearing hinge carried by said forward casing which surrounds said bearing means so that said bearing means is sandwiched between said bearing mount and said bearing hinge.

13. The apparatus of claim 12 wherein said bearing mount includes a plate disposed within an opening formed in said steering head and said plate is generally flush with a inside diameter of said steering head.

14. The apparatus of claim 12 wherein said bearing means is constructed from a low friction polymeric material.

15. The apparatus of claim 12 wherein said bearing means is constructed from a material which includes graphite.

16. The apparatus of claim 12 wherein said hinge means is slidable and includes a slide bearing carried by said forward casing; and a slide member carried in said slide bearing which is connected to said actuation means.

17. The apparatus of claim 16 including a pivot connecting said slide member to said bearing hinge about which rotation occurs about said second axis occurs.

18. The apparatus of claim 12 wherein said bearing mount includes an annular hub, said bearing means includes an annular bearing constructed from said low friction material surrounding said annular hub, and said bearing hinge rotates about said annular hub.

19. The apparatus of claim 1 including guidance means for measuring a vertical position and a horizontal position of said forward casing with respect to said first and second axes.

20. The apparatus of claim 19 wherein said guidance means includes sensor means for measuring a first position angle of said forward casing with respect to said first axis and a second position angle of said forward casing with respect to said second axis, and control means for controlling said actuator means in response to said first and second position angles to guide said steering head along a desired path.

21. Earth boring apparatus for boring and laying pipe casings underground from a boring pit to form a cased bore which includes means for forming a bore and pushing the pipe casings through the bore as it is formed, said apparatus comprising:

a plurality of pipe casings joined together having a forward casing at a forward end of said casings;

a steering head carried by said forward casing;

a cutting head carried by said steering head for forming said bore;

hinge means connecting said steering head and said forward casing so that said steering head rotates relative to said forward casing about a first axis and a second axis orthogonal to said first axis;

guidance means for measuring the horizontal and vertical positions of said pipe casings with respect to said first and second axes and for generating corresponding first and second position signals;

actuator means connected to said steering head for imparting an actuation force to rotate said steering head through said hinge means about said first and second axes;

drive means for driving said actuation means; and control means for controlling said drive means and said actuator means in response to said first and second position signals to steer said steering head along a desired path.

22. The apparatus of claim 21 wherein said guidance means includes:

first sensor means for measuring a first position angle of said casing with respect to said first axis and generating a first position angle; and second sensor means for measuring a second position angle of said casing with respect to a second axis and generating a second position angle.

23. The apparatus of claim 22 wherein said first and second sensor means includes:

a first angular rate sensor for measuring the angular rate of said casing about said first and second axes for generating a first angular rate signal;

a second angular rate sensor for measuring the angular rate of said casing about said first and second axes for generating a second angular rate signal; and integrator means for integrating said first and second angular rate signals to generate said first and second position angles.

24. The apparatus of claim 22 including distance measuring means for measuring the distance that said casing has traveled from said boring pit.

25. The apparatus of claim 24 wherein said distance measuring means includes an accelerometer for generating an accelerometer signal; and a distance integrator means for integrating said accelerometer signal for generating a distance signal.

26. The apparatus of claim 25 comprising computer means for processing said first and second position angles and said distance signals for calculating deviations in the position of said casing with respect to a desired bore path.

27. The apparatus of claim 26 including a visual display which displays said deviations and steering head position with respect to left and right deviations and vertical deviations.

28. The apparatus of claim 27 wherein said control means comprises manual control means for controlling said drive means in response to said display of deviations to nullify said deviations.

29. Earth boring apparatus for boring and laying pipe casings underground to form a cased bore from a boring pit, and includes means for forming a bore and pushing the pipe casings through the bore as it is formed, said apparatus comprising:

a plurality of pipe casings joined together having a forward casing at a lead end of said casings;

a steering head carried by said forward casing;

a cutting head carried by said steering head for forming said bore;

hinge means connecting said steering head and said forward casing so that said steering head rotates relative to said forward casing about a first axis and a second axis orthogonal to said first axis;

said hinge means including at least one slidable hinge assembly having an pivot axis coincident with said first axis and a second pivot having a pivot axis coincident with said second axis;

bearing means for slidably carrying said hinge assembly with respect to said forward casing; and means connecting said hinge assembly with said actuator means.

30. The apparatus of claim 29 wherein at least one of said first and second hinge means includes:

a bearing mount carried by said steering head;

bearing means carried about said bearing mount constructed from a low friction material; and a bearing hinge carried by said forward casing which surrounds said bearing means so that said bearing means is sandwiched between said bearing mount and said bearing hinge.

31. The apparatus of claim 30 wherein said bearing mount includes a plate disposed within an opening formed in said steering head and said plate is generally flush with an inside diameter of said steering head.

32. The apparatus of claim 30 wherein said bearing means is constructed from a low friction polymeric material.

33. The apparatus of claim 30 wherein said bearing mount includes an annular hub, said bearing means includes an annular bearing constructed from said low friction material surrounding said annular hub, and said bearing hinge rotates about said annular hub.

* * * * *